US007690316B2

(12) United States Patent
Yoo et al.

(10) Patent No.: US 7,690,316 B2
(45) Date of Patent: Apr. 6, 2010

(54) HEIGHT-ADJUSTABLE FOLDING WORK PLATFORM

(75) Inventors: Hoe Gwan Yoo, Stanton, CA (US); Jung Hwan Lim, Stanton, CA (US)

(73) Assignee: Thomas Yoo, Garden Grove, CA (US)

( * ) Notice: Subject to any disclaimer, the term of this patent is extended or adjusted under 35 U.S.C. 154(b) by 812 days.

(21) Appl. No.: 11/315,611

(22) Filed: Dec. 22, 2005

(65) Prior Publication Data

US 2006/0130715 A1 Jun. 22, 2006

(30) Foreign Application Priority Data

Dec. 22, 2004 (KR) ..... 10-2004-0110369

(51) Int. Cl.
*A47B 3/00* (2006.01)

(52) U.S. Cl. ..... 108/115; 182/152

(58) Field of Classification Search ..... 108/115, 108/116, 117, 131, 132, 167–175, 177; 182/152, 182/186.6
See application file for complete search history.

(56) References Cited

U.S. PATENT DOCUMENTS 1,832,537 A * 11/1931 Erwin ..... 182/152
2,446,005 A * 7/1948 Hartmann ..... 182/152
4,157,089 A * 6/1979 Loughrey ..... 108/116
4,341,164 A * 7/1982 Johnson ..... 108/115
4,715,296 A * 12/1987 Wilkinson ..... 108/116
4,951,781 A * 8/1990 Bliss ..... 182/152
5,368,126 A * 11/1994 Woodward et al. ..... 182/152
5,542,639 A * 8/1996 Wixey et al. ..... 108/117
6,289,824 B1 * 9/2001 Parker et al. ..... 108/115
6,334,400 B1 * 1/2002 Nien ..... 108/115
6,378,445 B1 * 4/2002 Willard et al. ..... 108/115
6,705,234 B1 * 3/2004 Miller et al. ..... 108/115
7,428,762 B1 * 9/2008 Kalies ..... 182/152

* cited by examiner

*Primary Examiner*—José V Chen
(74) *Attorney, Agent, or Firm*—John K. Park; Park Law Firm

(57) ABSTRACT

A height adjustable folding work platform includes two footplates, a footplate folding portion that foldably connects the footplates, two legs, and two leg folding portions, each of which connect the leg to the outer end of the footplate. Each of the legs includes two support legs and a plurality of cross members that connect the support legs. The leg folding portion selectively engages with one of the cross members so that the height of the height adjustable folding work platform is adjusted.

5 Claims, 23 Drawing Sheets

200
202
204
206
208
210
212
IX
IX 202
208
120
202
208
120
202
208

HEIGHT-ADJUSTABLE FOLDING WORK PLATFORM

CROSS REFERENCE TO RELATED APPLICATIONS

The application claims priority on Korean Patent Application No. 10-2004-0110369, filed on Dec. 22, 2004, and the disclosure of which is incorporated by reference into this application as if fully set forth herein.

BACKGROUND OF THE INVENTION

The present invention relates to a work platform. More particularly, this invention relates to a work platform, the height of which is adjustable, and the elements of which are foldable.

Generally, a ladder or a chair is used to replace devices fixed at the ceiling such as electric lamps at home or office.

However, a ladder or a chair is inconvenient for papering a ceiling or a wall since they have narrow width. Therefore, papering workers usually use a work platform, which is made to have an extended length in transverse direction, and moves along the platform during papering work.

FIG. 1 shows a work platform by prior art. The work platform includes a footplate 410 that is an elongated panel extends transversely, and a pair of legs 420, which are provided at the ends of the footplate 410, and support the footplate 410 over the ground, and are foldable with respect to the footplate 410. A folding bar 440 is provided between each of the legs 420 and the footplate 410 in order to support and fold the leg 420 with respect to the footplate 410. The folding bar 440 includes a first link 441, one end of which is fixed to a support bar 430 that connects the pair of legs 420, and a second link 442, one end of which is fixed to the footplate 410 from below and the other end of which is hinged with the first link 441.

The work platform becomes portable with the folding bars 440 are folded, and the pair of legs 420 are folded toward the lower portion of the footplate 410. In order to use the platform the first link 441 and the second link 442 of the folding bar 440 are unfolded to be straight and the pair of legs 420 are unfolded so that they are almost perpendicular to the footplate 410. Then the work platform 410 is put on the ground.

The disadvantages of the work platform 410 are that the length of the platform is too long to carry since only the legs are folded, and since the height is fixed working is limited only those that correspond to the given platform.

There has long been a need for a work platform that is compact in its folded state, that is convenient to fold, and the length and height are adjustable.

SUMMARY OF THE INVENTION

The present invention contrives to solve the disadvantages of the prior art.

An objective of the invention is to provide a folding work platform that is sturdy and can fully withstand weight of a worker standing on the platform.

Another objective of the invention is to provide a folding work platform that can be folded with easy operation.

Still another objective of the invention is to provide a folding work platform that can adjust its height.

In order to achieve the above objectives, the present invention provides a height adjustable folding work platform that includes two footplates, a footplate folding portion that foldably connects the footplates, two legs, and two leg folding portions, each of which connect the leg to the outer end of the footplate. Each of the legs includes two support legs and a plurality of cross members that connect the support legs, wherein the leg folding portion selectively engages with one of the cross members whereby the height of the height adjustable folding work platform is adjusted.

The height adjustable folding work platform further includes a footplate folding portion. One or more projection pins are provided on the sides of inner end of the footplate. The footplate folding portion includes a receiving space, into which the inner end of the footplate is inserted, one or more guide recesses, which are provided on both sides of the receiving space, and into which the projection pins are inserted, and two cut grooves that are provided on the ends of the lower portion of the footplate folding portion.

The footplate further includes one or more receiving recesses and one or more reinforce bars. The reinforce bar slides within the receiving recess of one of the footplates, and one end of the reinforce bar is inserted into the receiving recess of the other of the footplates.

The footplate further includes one or more latches. The latches lock the reinforce bar at a predetermined position.

The leg folding portion includes a first fixing portion that is fixed the outer end of the footplate, a second fixing portion that is attached to the upper end of the leg, and a hinge axis that pivotally connects the first fixing portion and the second fixing portion.

The first fixing portion includes an engaging hook that engages with the cross member of the leg and is provided on the outer end of the first fixing portion. The second fixing portion includes a guide rail, into which the leg slides.

The first fixing portion further includes a safety hook. The safety hook is pivotally attached to the engaging hook. The safety hook includes a hook that is formed on the end of the safety hook.

In another embodiment of the present invention, the footplate folding portion includes a first and second brackets, each of which is fixed to the footplate, and a hinge axis that pivotally connects the first and second brackets. The first and second brackets abut with each other when the footplates are unfolded thereby preventing further unfolding of the footplates.

The leg folding portion includes a first fixing portion that is fixed the outer end of the footplate, a second fixing portion, a hinge axis that pivotally connects the first fixing portion and the second fixing portion, and a safety lock device that prevents accidental folding of the legs.

The safety lock device includes a first lever and a second lever. One end of the first lever is pivotally connected to the first fixing portion at a first pivot point. One end of the second lever is pivotally connected to the second fixing portion at a second pivot point. The other end of the first lever is pivotally connected to the other end of the second lever at a middle pivot point. The middle pivot point is spaced downward from the line connecting the first pivot point and the second pivot point when the safety lock device is in a locked position, and the middle pivot point is spaced upward from the line connecting the first pivot point and the second pivot point when the safety lock device is in a unlocked position, so that the safety lock device locks the legs unfolded when the safety lock device is in the locked position.

The first lever has a handle that is adapted to receive manual force to move the middle pivot point between the downward and upward positions.

The safety lock device pivots the second fixing portion inward as the middle pivot point moves upward.

The first fixing portion includes an engaging hook that engages with the cross member of the leg and is provided on the outer end of the first fixing portion.

The second fixing portion includes a guide rail, into which the leg slides.

The advantages of the present invention are: (1) the folding work platform is sturdy and rigid with its sliding construction at its unfolded state; (2) the work platform is convenient since its height is easily and adjusted; (3) the work platform is convenient to store and carry since the footplate and the legs are folded.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
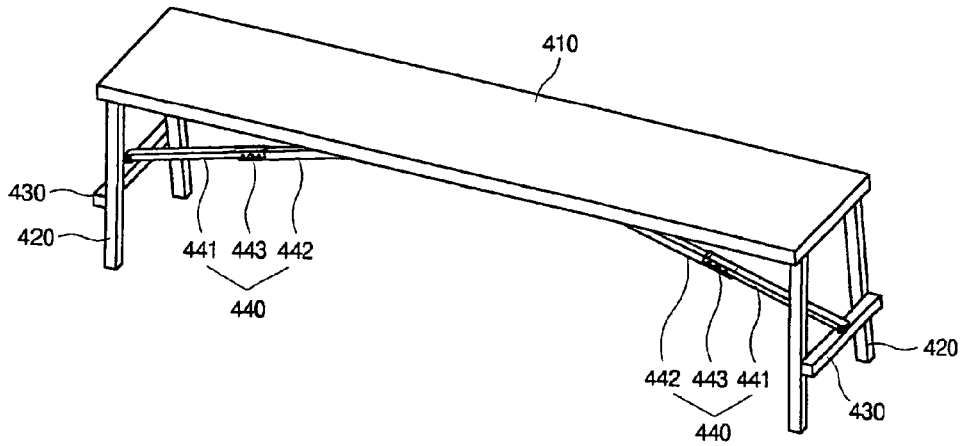
FIG. 1 (PRIOR ART)
FIG. 1 is a perspective view of a work platform by prior art.
Figure 2:
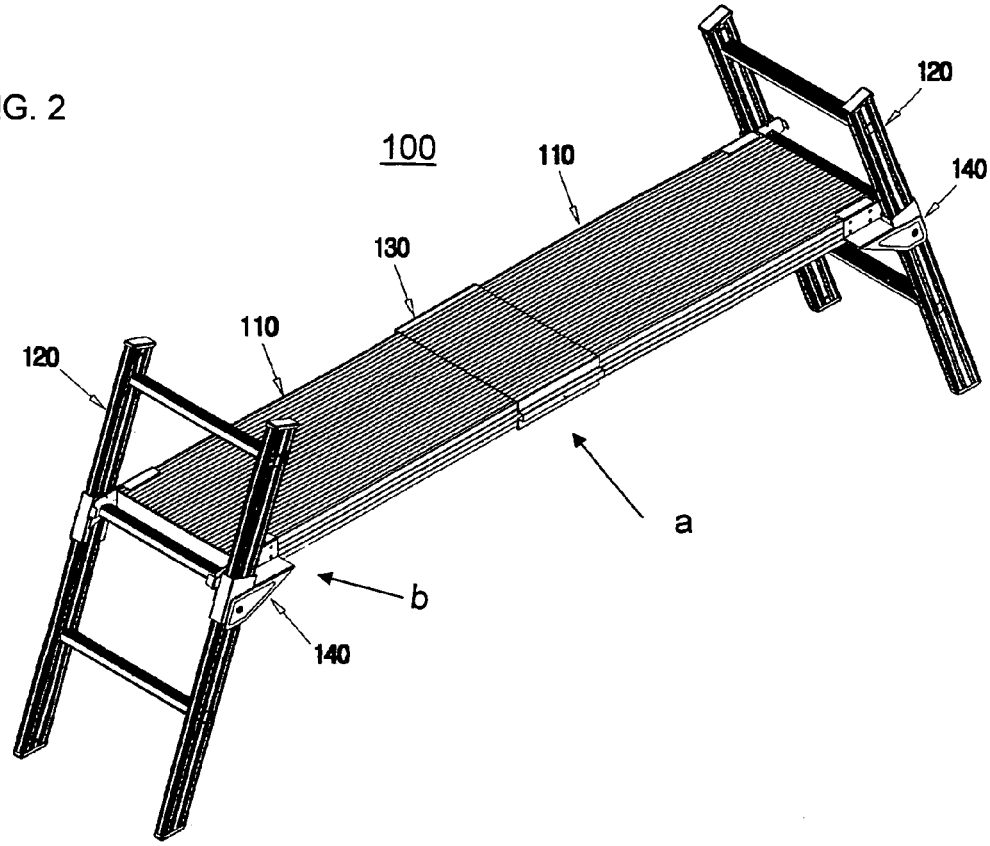
FIG. 2 is a perspective view of a folding work platform of one embodiment of the present invention.
Figure 3:
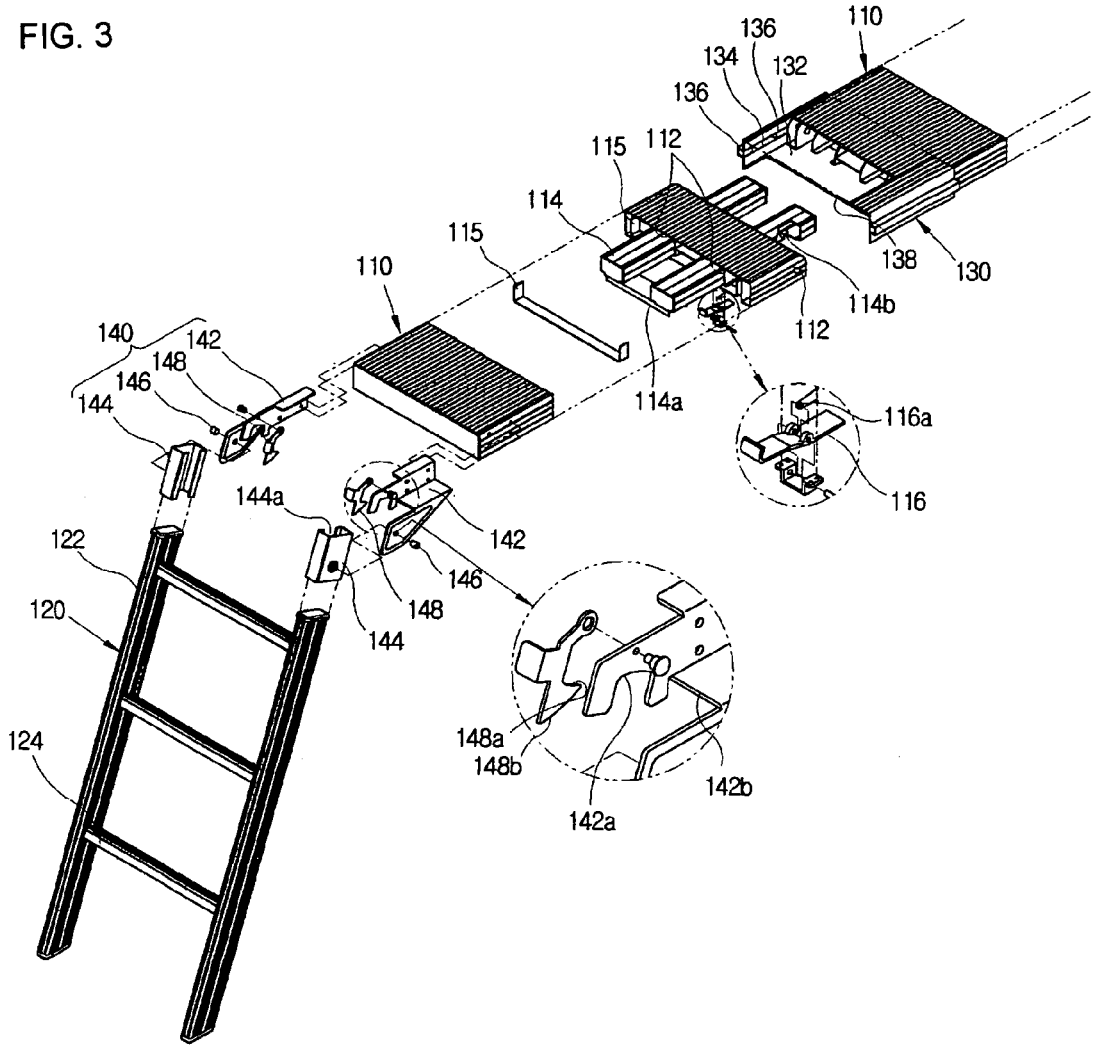
FIG. 3 is an exploded perspective view of the folding work platform.

FIGS. 2 and 3 show a folding work platform 100 that includes a pair of footplates 110, two legs 120 that are fixed to the outer ends of the footplates 110, a footplate folding portion 130 that connects the two footplates 110 in a way that they are foldable, and two leg folding portion 140 by which the legs 120 are pivotally connected to the footplates 110.

The footplate 110 is made of material that can withstand the weight of a worker. The footplate 110 includes projection pins 111 that are provided on the inner end, receiving recesses 112 that are formed inward, reinforce bars 114, one end of which forms a handle 114*a*, and the other end of which forms a latching recess 114*b*, and which is inserted into the receiving recess of the footplate 110, stoppers 115 that are formed on the inner and outer ends in order to limit moving distance of the reinforce bars 114, and latches 116 that are fixed on the stopper 115, and biased by torsion springs 116*a*, and the distal ends of which are engaged with latching recesses 114*b* of the reinforce bar 114.

The leg 120 is fixed to the outer end of the footplate 110, and includes a pair of support legs 122, and a plurality of cross members 124 that connects the support legs 122 at a predetermined interval.

The footplate folding portion 130 has a shape of a hollow rectangular case that forms a receiving space 132. Guide recesses 134 into which the projection pins 111 are inserted are formed on both sides of the footplate folding portion 130. Stop blocks 136 are provided inside the guide recesses 134 in order to limit the moving distance of the projection pin within the guide recess 134. Cut grooves 138 are formed on the lower portion of the ends of the footplate folding portion 130.

The leg folding portion 140 includes a first fixing portion 142, a second fixing portion 144, a hinge axis 146, and a safety hook 148. The first fixing portion 142 is fixed to the footplate 110, and forms an engaging hook 142*a* at its distal end and a stopping flange 142*b* that is folded and provided at its middle portion. The second fixing portion 144 is slidably attached to the support leg 122 of the leg 120, and forms a guide rail 144*a* into which the support leg 122 is inserted. The hinge axis 146 connects the first fixing portion 142 and the second fixing portion 144. The safety hook 148 forms a hook 148*a* that surrounds the cross member 124 of the leg 120 at its distal end. The safety hook 148 is pivotally attached to the engaging hook 142*a* of the first fixing portion 142. A slanted surface 148*b* is formed on the outer end of the hook 148*a* of the safety hook 148.

The operation of the folding work platform 100 is explained below.

Figure 4A:
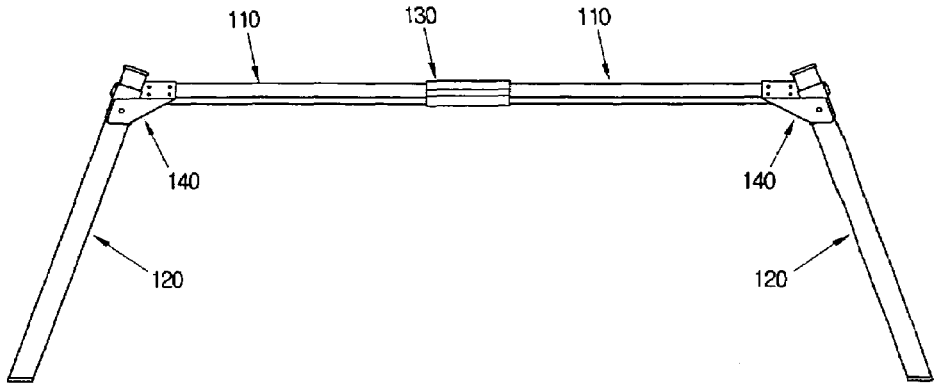
FIGS. 4*a*, 4*b*, 4*c* are elevation views showing steps for folding of the platform.

FIG. 4*a* shows that the two footplates 110 are fixed as unfolded state by being inserted into the footplate folding portion 130, and that the legs 120 are fixed to the outer end of the footplate 110 as unfolded state with the leg folding portion 140. This facilitates for a worker to work on higher places.

Figure 4B:
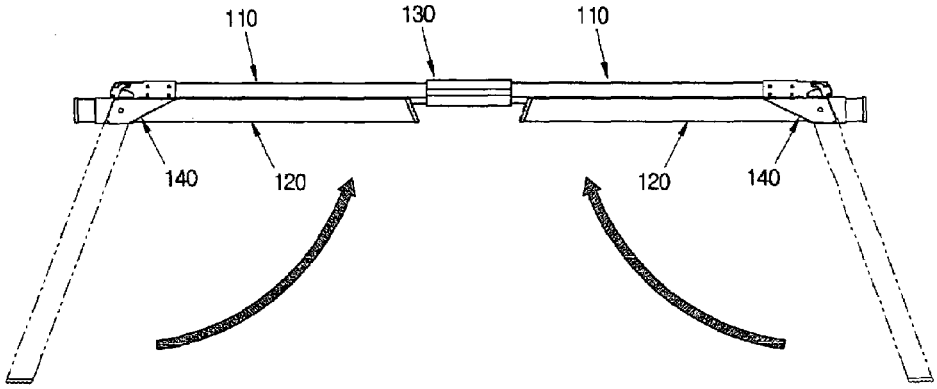

FIG. 4*b* shows that the leg 120, which is fixed to the outer end of the footplate 110, is pivoted and folded inward with the leg folding portion 140.

Figure 4C:
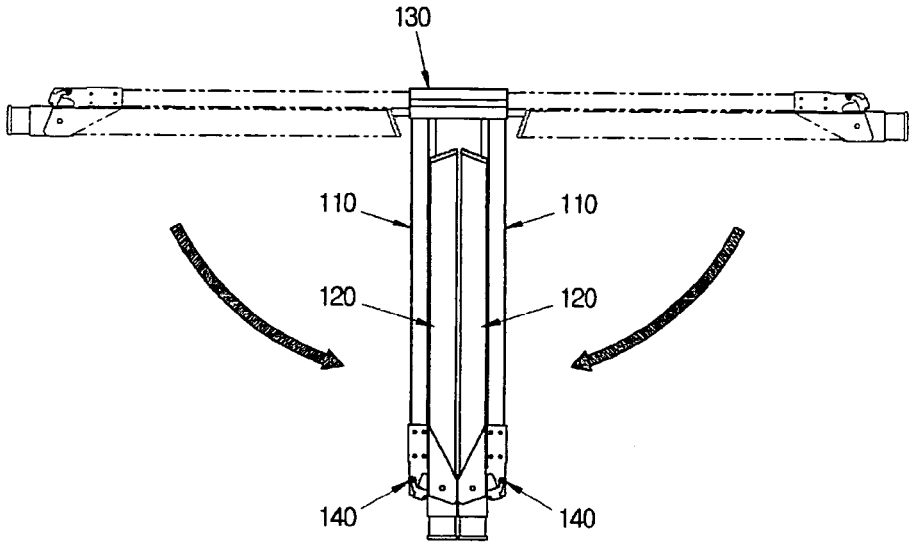

FIG. 4*c* shows that the two footplates 110 are pivoted and folded inward with respect to the footplate folding portion 130 to facilitate storing and carrying.

Figure 5A:
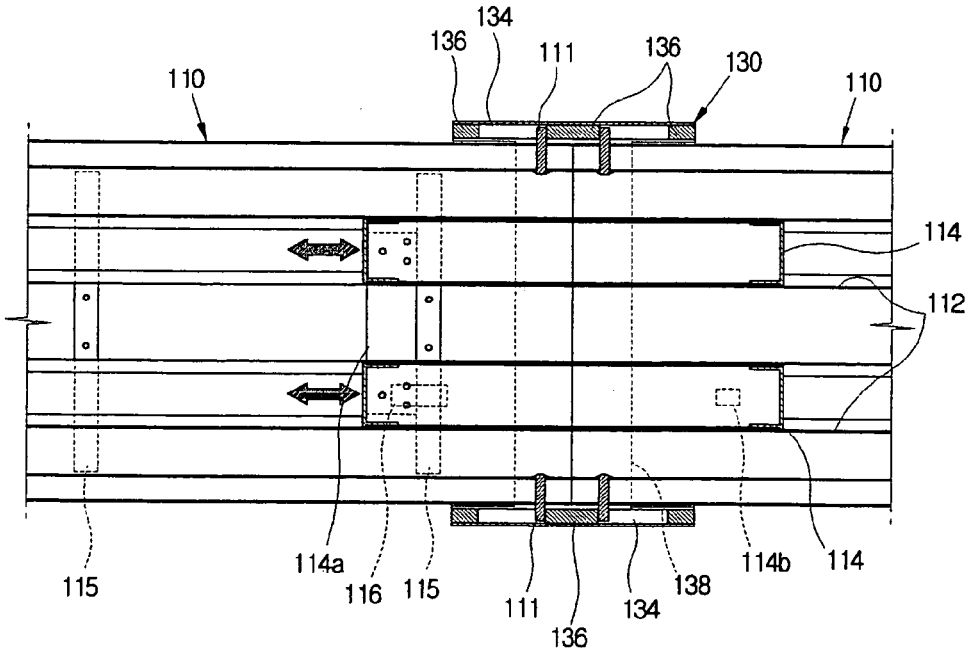
FIGS. 5*a*, 5*b* are cross sectional views showing the structures of the portion "a" in FIG. 2.
Figure 5B:
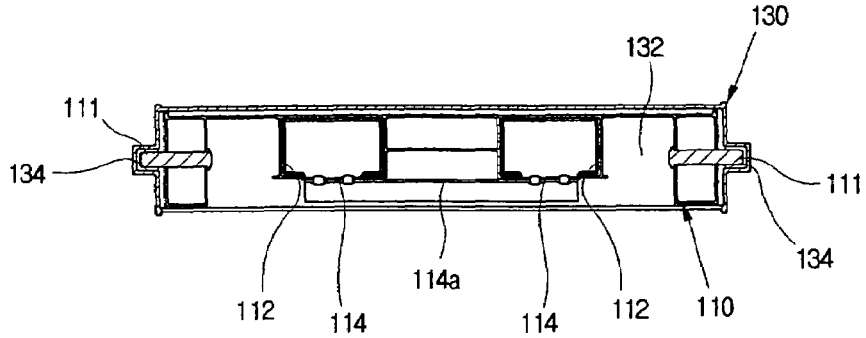

FIGS. 5*a* and 5*b* show that one end of the footplate 110 is inserted into both ends of the footplate folding portion 130 and positioned within the receiving space 132. The projection pins 111 that are formed on the sides of the footplate 110 are positioned between a plurality of stop blocks 136 that are fixed in the guide recess 134 of the footplate folding portion 130. Accordingly, the footplate 110 slides within the space limited by the stop blocks 136 of the guide recess 134. The footplate 110 slides inward in the receiving space 132, and when it is inserted, the footplate 110 is fixed as unfolded state. When the footplate 110 is pulled out, the footplate 110 is pivoted downward around the cut groove 138.

Figure 6A:
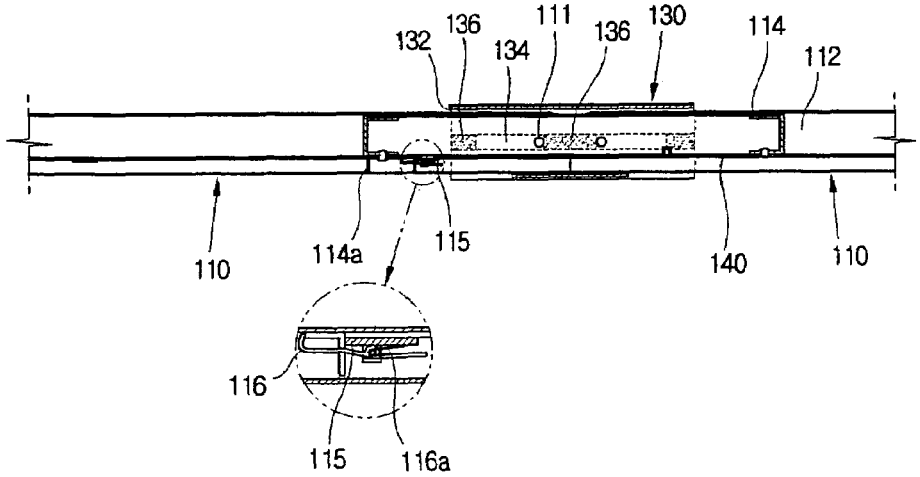
FIGS. 6*a* through 6*d* are cross sectional views showing the operations of the portion "a" in FIG. 2.

FIG. 6*a* shows that the handle 114*a* is used to insert the end of the reinforce bar 114, which is slidably inserted into the receiving recess 112 that is formed inside the footplate 110, into the receiving recess 112 of the other footplate 110. This prevents accidental folding of the footplates 110 during use.

Figure 6B:
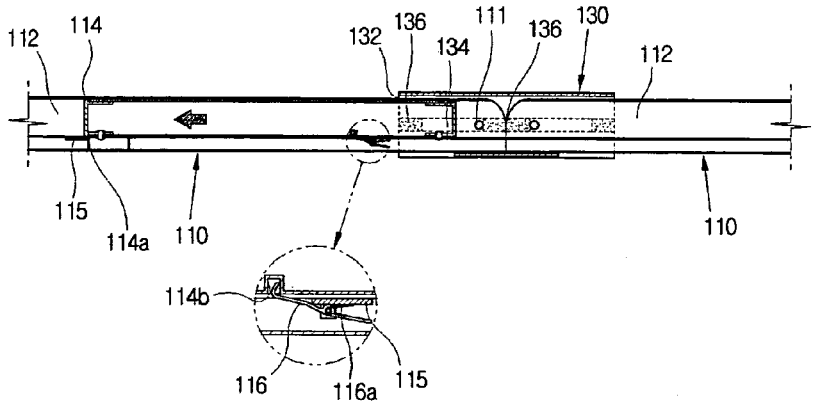

FIG. 6*b* shows that the end of the reinforce bar 114 is moved backward with the handle 114*a* out of the receiving recess 112 of the footplate 110, and the backward movement is limited by the stopper 115. At this moment, the latch 116, which is biased by the torsion spring 116*a* on the stopper, engages into the latching recess 114*b* and thus locked thereby preventing accidental further movement of the reinforce bar 110.

Figure 6C:
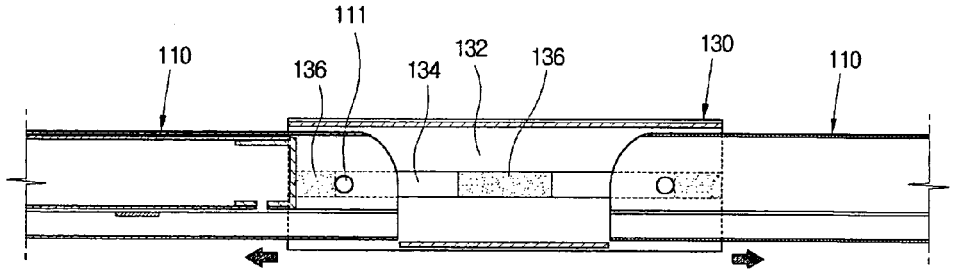

FIG. 6*c* shows that when the footplate 110 is pulled out, the projection pin 111 moves within the guide recess 134 until it abuts with the outer stop block 136.

Figure 6D:
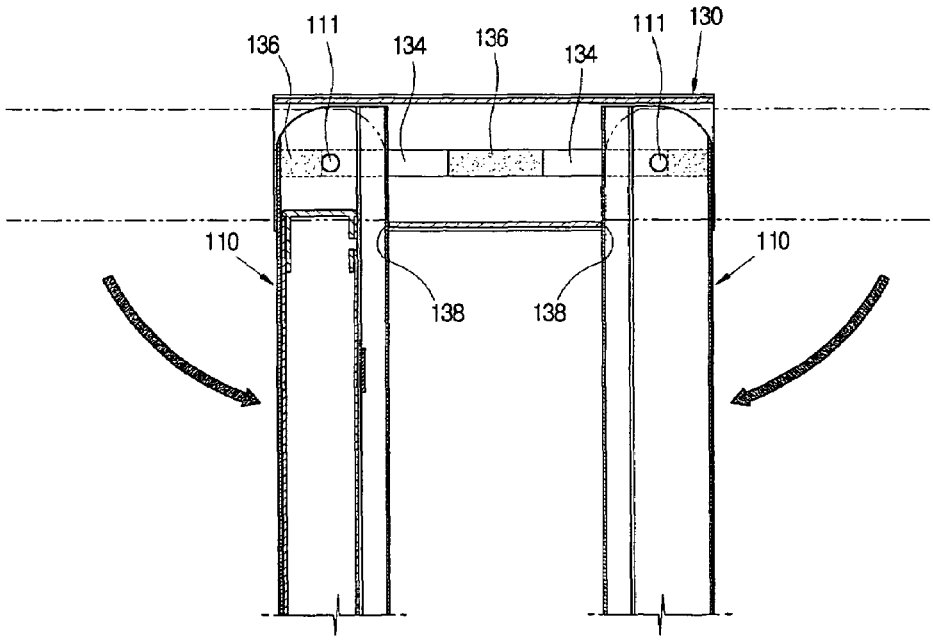

FIG. 6*d* shows that the footplate 110 is pivoted and folded downward abutting with the cut groove 138 that is formed on both sides on the lower part of the footplate folding portion 130.

Figure 7A:
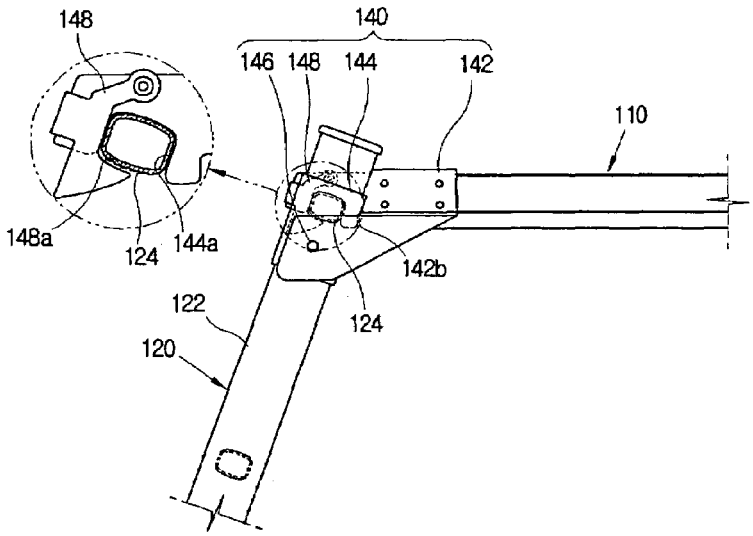
FIGS. 7*a* through 7*d* are cross sectional views showing the folding operations of the portion "b" in FIG. 2.

FIG. 7*a* shows that the leg folding portion 140 is installed between the outer end of the footplate 110 and the leg 120, and the leg 120 may be folded with respect to the footplate 110. The support leg 122 is longitudinally and slidingly inserted into the guide rail 144*a* of the second fixing portion 144 which is attached to the first fixing portion 142 with the hinge axis 146. The cross member 124 is supported by the engaging hook 142*a* so that the cross member 124 is prevented from upward movement. The hook 148*a* of the safety hook 148, which is pivotally connected to the side of the engaging hook 142*a*, surrounds the lower part of the cross member 124 due to its own weight thereby preventing the cross member 124 from downward movement. In this way, the position of the cross member 124 with respect to the guide rail 144*a* is fixed, and one side of the second fixing portion 144 is supported by the stopping flange 142*b* so that the outward pivoting of the leg 120 is prevented and the leg 120 is fixed as unfolded state.

Figure 7B:
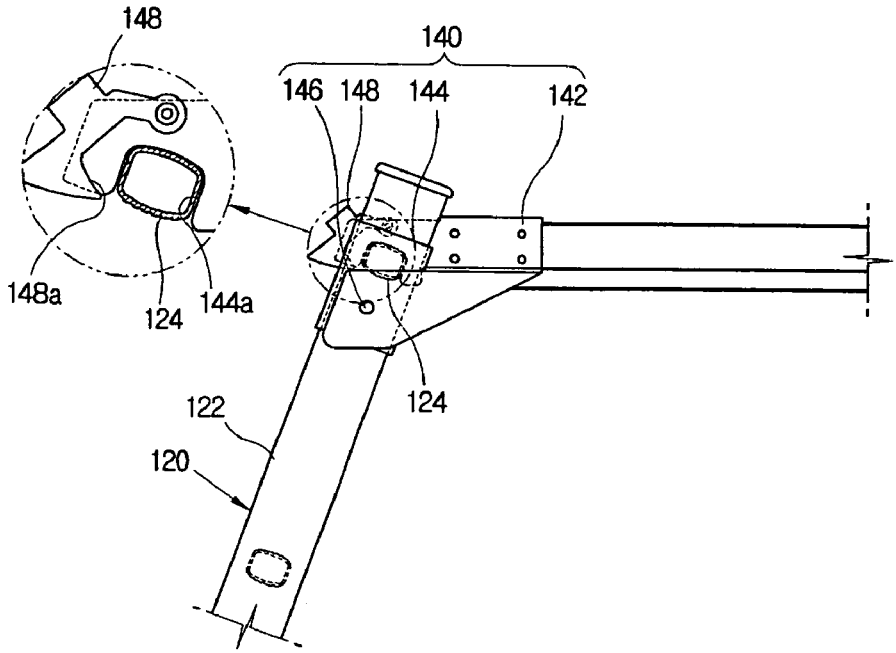

FIG. 7*b* shows that the safety hook 148 is pivoted outward thereby releasing the cross member 124.

Figure 7C:
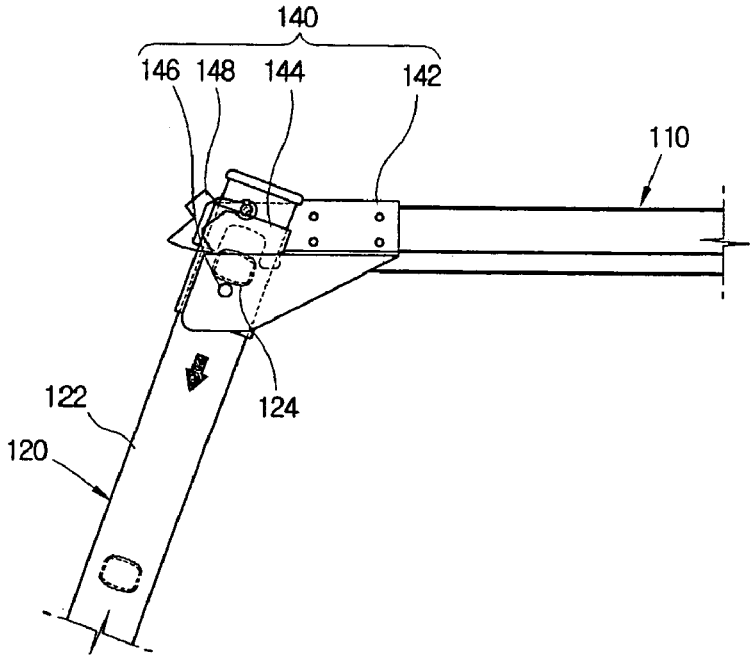

FIG. 7*c* shows that the leg 120 is slid down along the guide rail 144*a* so that the support leg 120 is moved out of the engaging hook 142*a* of the first fixing portion 140.

Figure 7D:
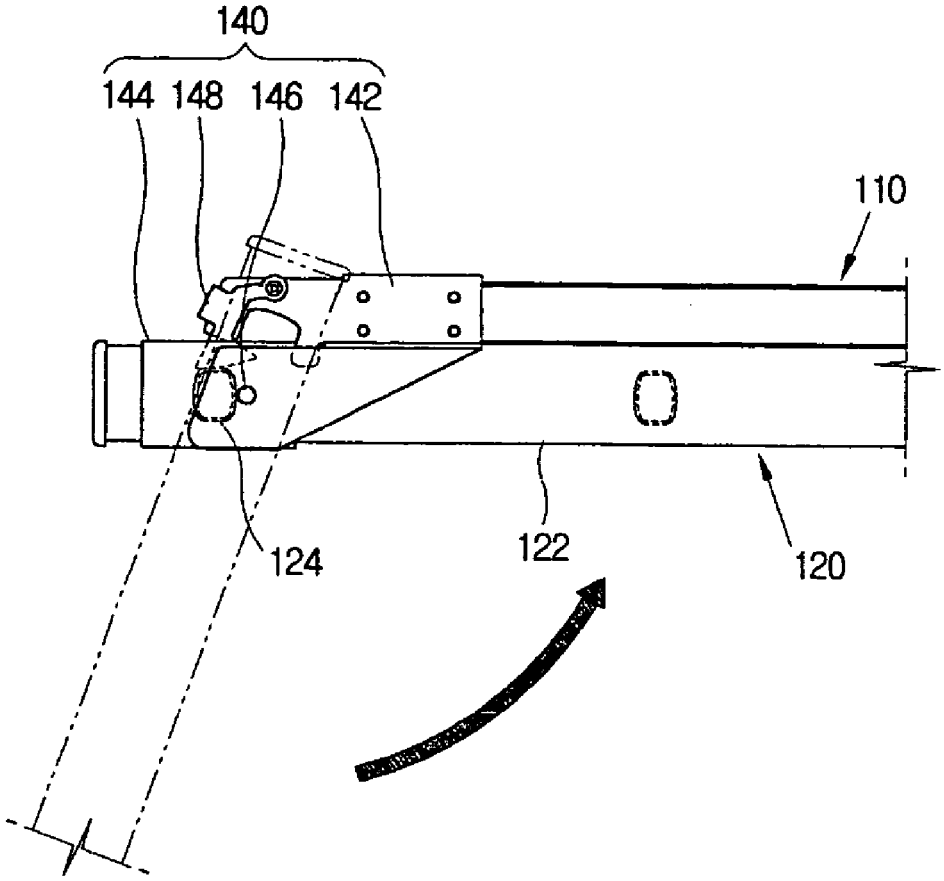

FIG. 7*d* shows that the second fixing portion 140 is pivoted so that the leg 120 is pivoted and folded with respect to the hinge axis 146.

Figure 8A:
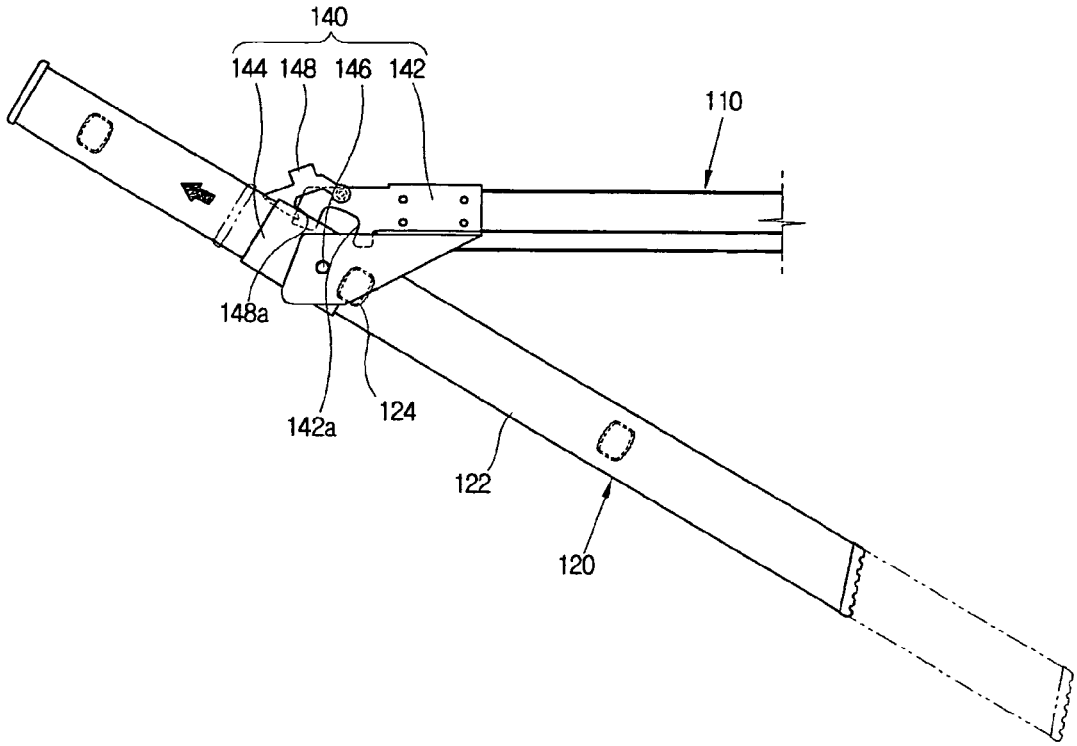
FIGS. 8*a*, 8*b* and 8*c* are cross sectional views showing the height adjusting operation of the portion "b" in FIG. 2.

In order to adjust the height of the leg 120 in the unfolded state, the safety hook 148, which is pivotally connected to the side of the engaging hook 142, is pivoted outward as shown in FIG. 7*b*. FIG. 8*a* shows that the second fixing portion 144 is pivoted inward so that the cross member 124 does not interfere with the engaging hook 142*a* of the first fixing portion 142, and the leg 120 is moved to a desired height along the guide rail 144*a*. The guide rail 144*a*, which surrounds the support leg 122, has inner opening so that the cross member 124, which connects between the support legs 122, can pass through.

Figure 8B:
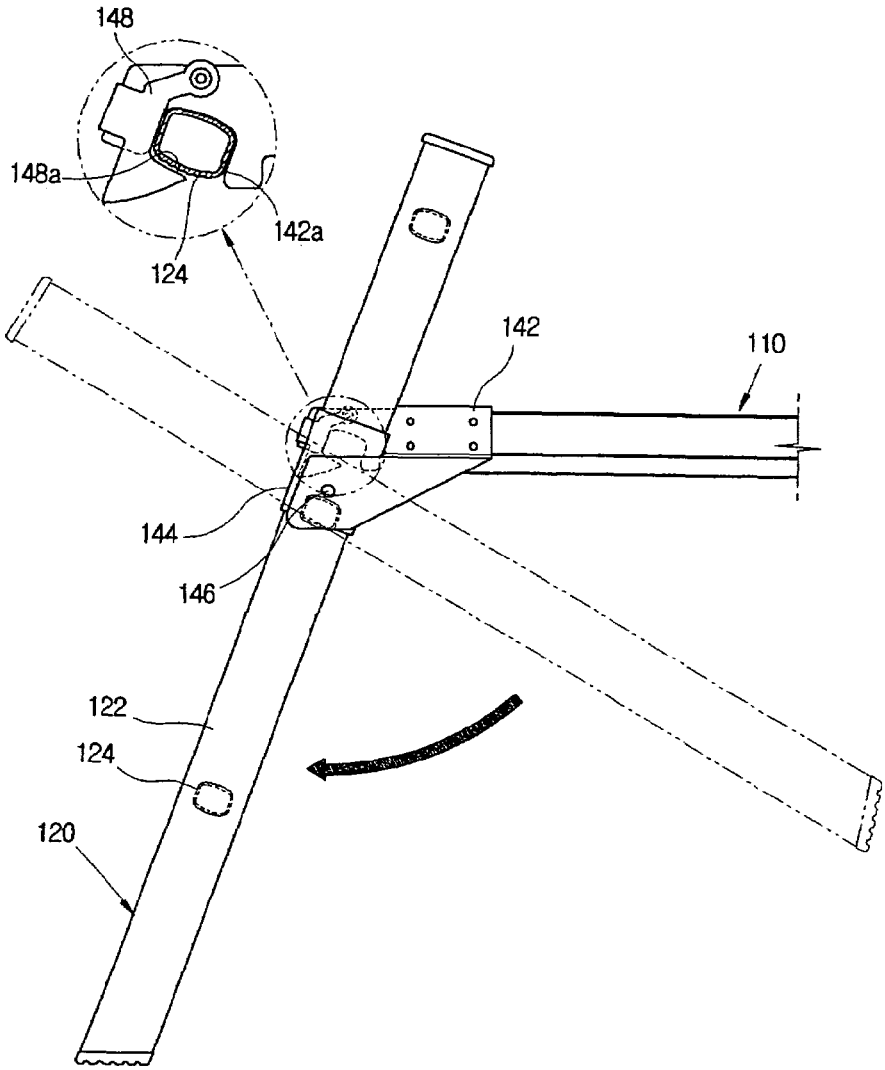
Figure 8C:
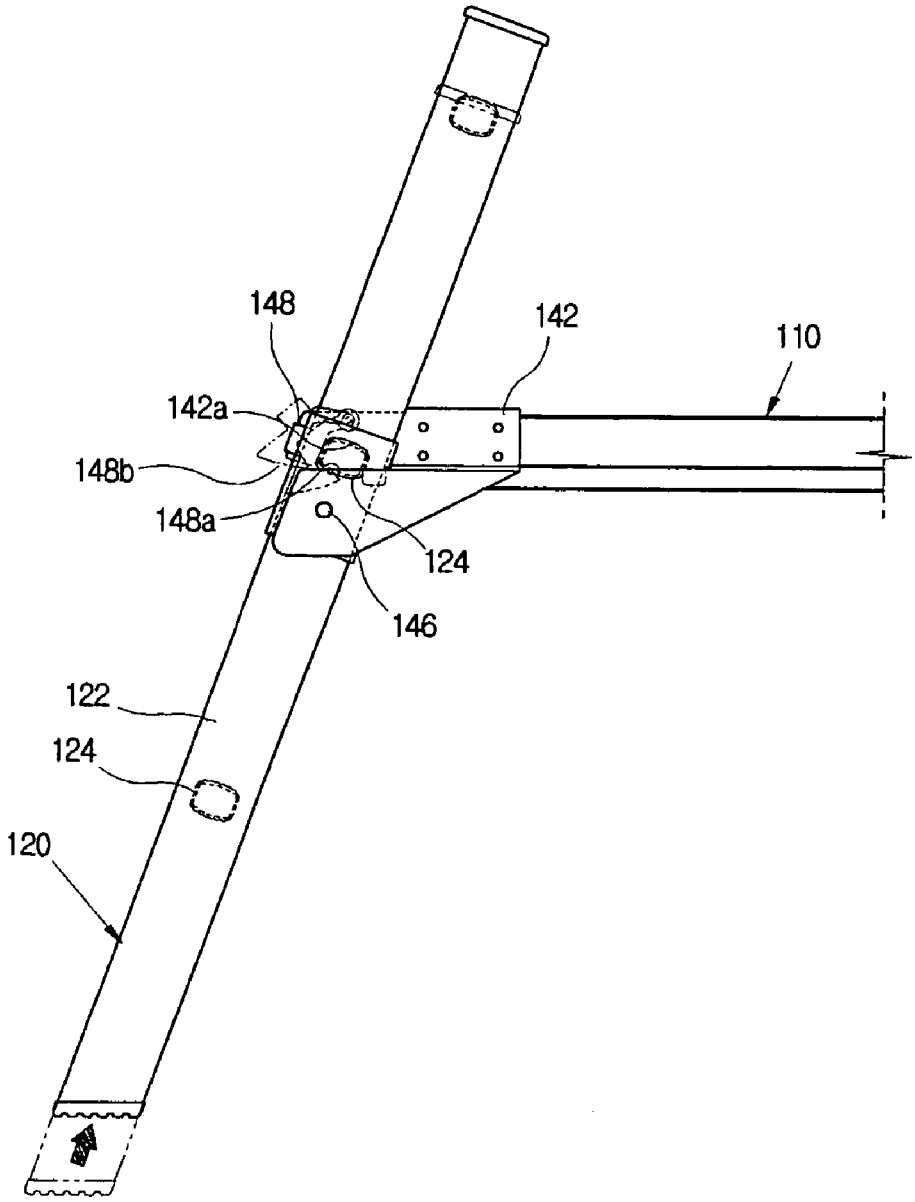

FIG. 8*b* shows the second fixing portion 144 is completely unfolded so that one side of the second fixing portion 144 is supported by the stopping flange 142*b* of the first fixing portion 142, and the leg 120 is moved upward along the guide rail 144*a* so that the cross member 124 engages with the engaging hook 142*a* of the first fixing portion 142. At this moment, the cross member 124 pushes the slanted surface 148*b* of the hook 148*a*, as it moves upward. When the cross member 124 passes beyond the slanted surface 148*b* and is positioned inside the hook 148*a*, the safety hook 148 returns to its downward position due to its weight, and the hook 148*a* of the safety hook 148 surrounds the lower portion of the cross member 124. In summary, the engaging hook 142*a* of the first fixing portion 142 and the hook 148*a* of the safety hook 148 fix the position of the leg 120 by fixing the cross member 124 that slides in the guide rail 144*a* of the second fixing portion 144. In this way, a user can conveniently use the work platform 100 by adjusting the height of the leg 120 according to the height required for a task.

FIGS. 9~26 show a folding work platform 200 according to another embodiment of the invention. The folding work platform 200 is different from the first embodiment in the features explained below.

Figure 9:
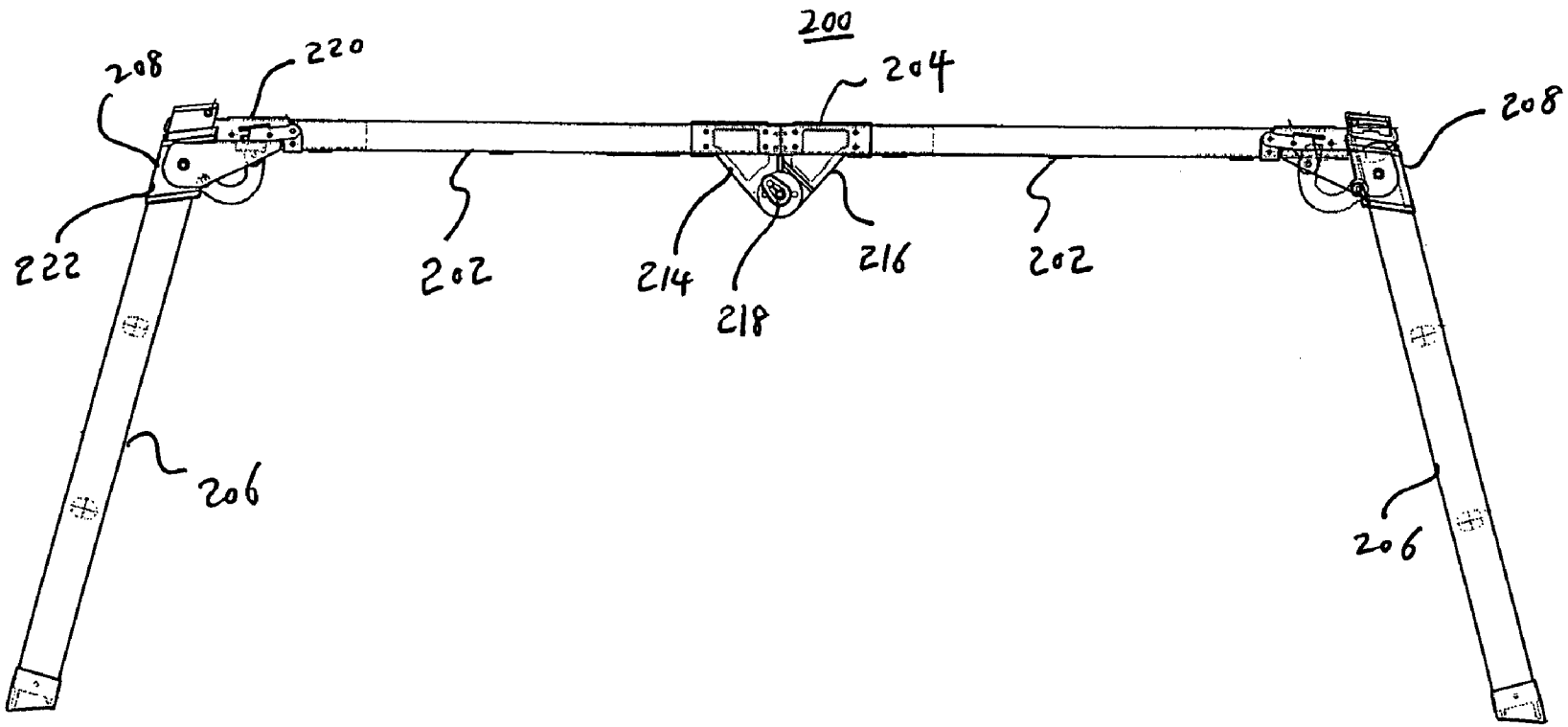
FIG. 9 is a front elevation view of a folding work platform according to another embodiment of the present invention.
Figures 10, 11, 12, 13, 14:
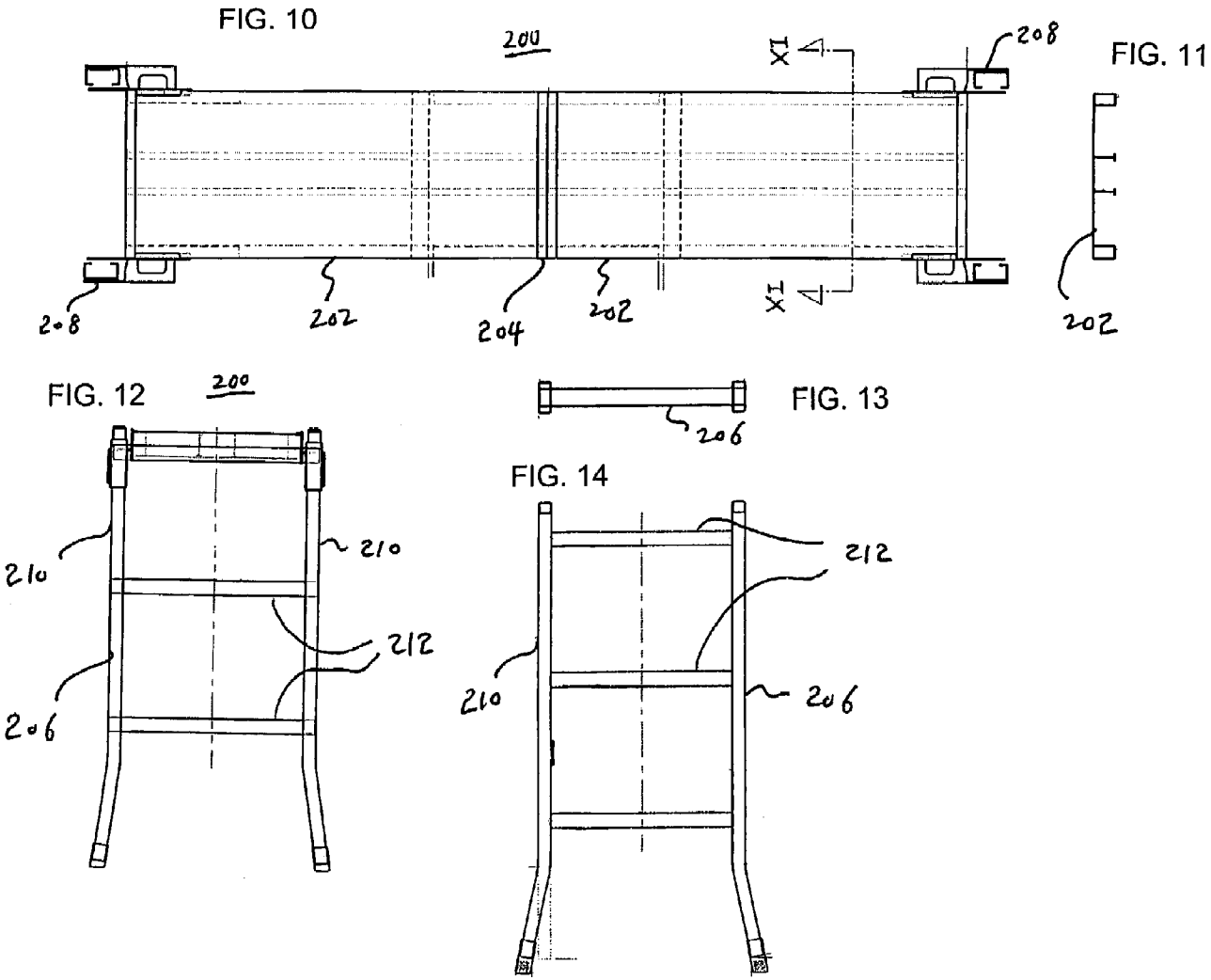
FIG. 10 is a plan view of the folding work platform.
FIG. 11 is a cross sectional view taken along line XI-XI of the present invention.
FIG. 12 is a side elevation view of the folding work platform.
FIG. 13 is a plan view of a leg.
FIG. 14 is an elevation view of the leg.
Figure 15:
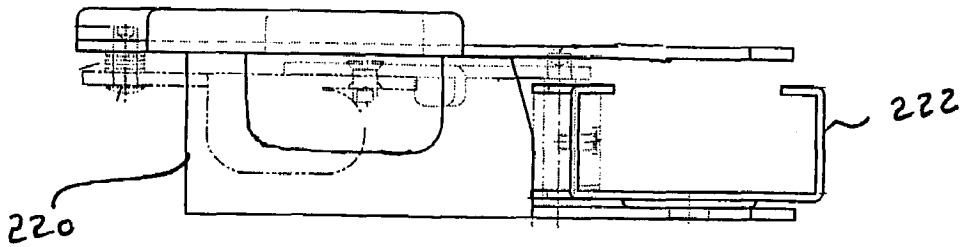
FIG. 15 is a plan view of a first fixing portion.
Figure 17:
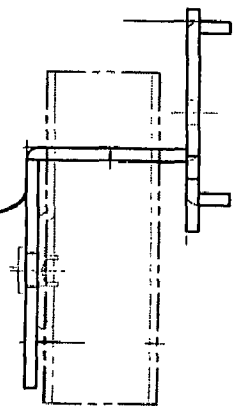
FIG. 17 is a side elevation view of the first fixing portion.
Figure 16:
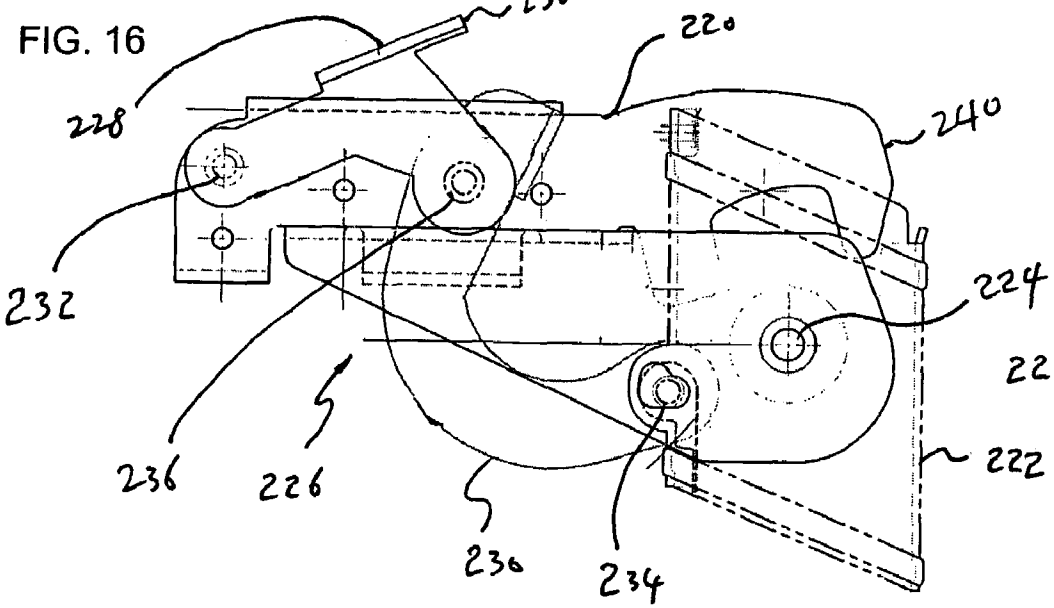
FIG. 16 is a front elevation view of the first fixing portion.
Figure 18:
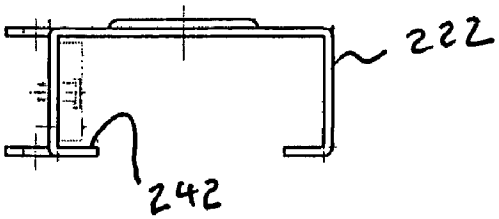
FIG. 18 is a plan view of a second fixing portion.
Figure 19:
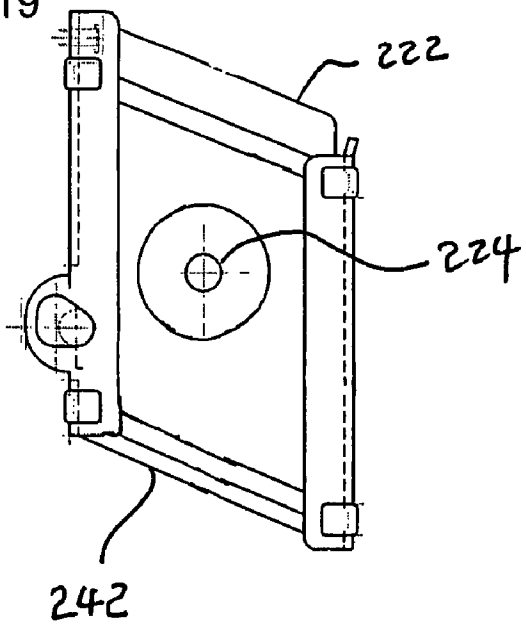
FIG. 19 is a front elevation view of the second fixing portion.
Figure 20:
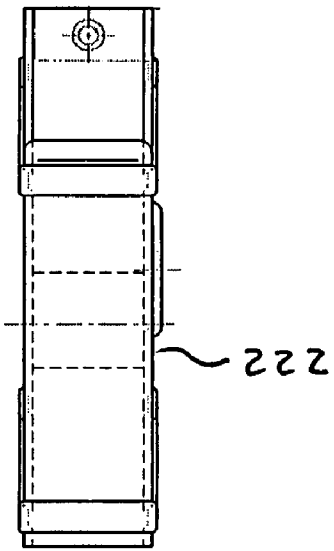
FIG. 20 is a side elevation view of the second fixing portion.
Figure 21:
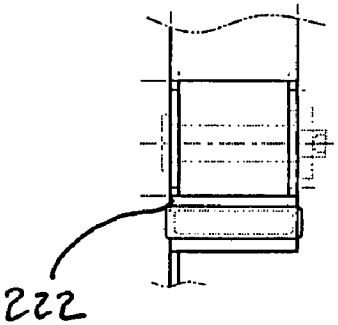
FIG. 21 is a partial side elevation view of the second fixing portion.

Referring to FIG. 9, the folding work platform 200 includes two footplates 202, a footplate folding portion 204 that foldably connects the footplates 202, two legs 206, two leg folding portions 208, each of which connect the leg 206 to the outer end of the footplate 202. Referring to FIGS. 12~14, each of the legs 206 includes two support legs 210 and a plurality of cross members 212 that connect the support legs 210.

Referring back to FIG. 9, the footplate folding portion 204 includes a first and second brackets 214, 216, each of which is fixed to the footplate 202, and a hinge axis 218 that pivotally connects the first and second brackets 214, 216. The first and second brackets 214, 216 abut with each other when the footplates 202 are unfolded thereby preventing further unfolding of the footplates 202.

FIGS. 15~21 show that the leg folding portion 208 includes a first fixing portion 220 that is fixed the outer end of the footplate 202, a second fixing portion 222, a hinge axis 224 that pivotally connects the first fixing portion 220 and the second fixing portion 222, and a safety lock device 226 that prevents accidental folding of the legs 206.

The safety lock device includes a first lever 228 and a second lever 230. One end of the first lever 228 is pivotally connected to the first fixing portion 220 at a first pivot point 232. One end of the second lever 230 is pivotally connected to the second fixing portion 222 at a second pivot point 234. The other end of the first lever 228 is pivotally connected to the other end of the second lever 230 at a middle pivot point 236.

Figure 24A:
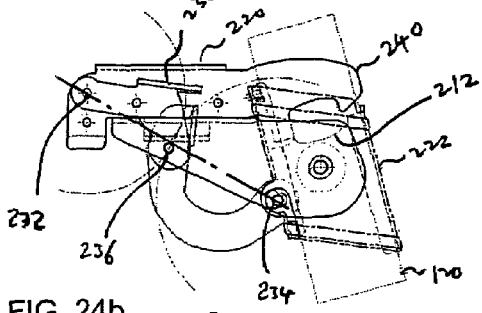
FIGS. 24*a* through 24*g* are elevation views showing the steps of folding the leg.
Figure 24B:
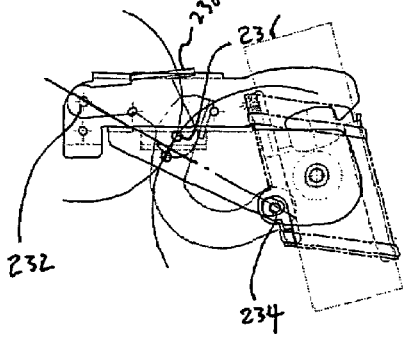
Figure 24C:
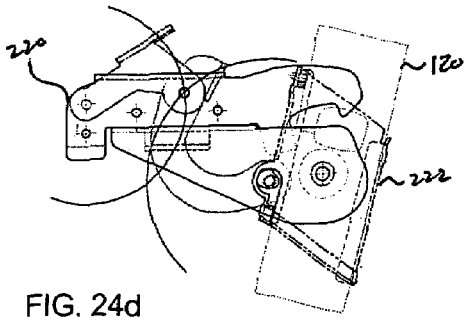
Figure 24D:
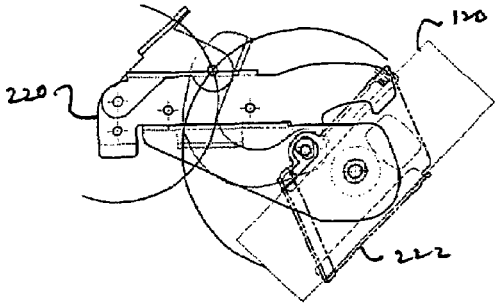
Figure 24E:
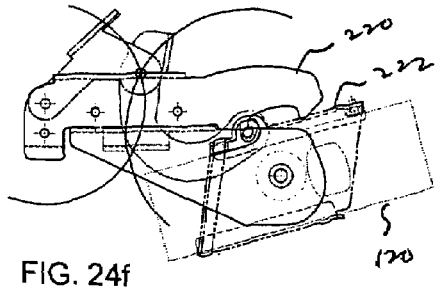
Figure 24F:
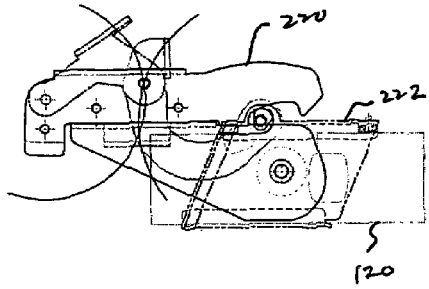
Figure 24G:
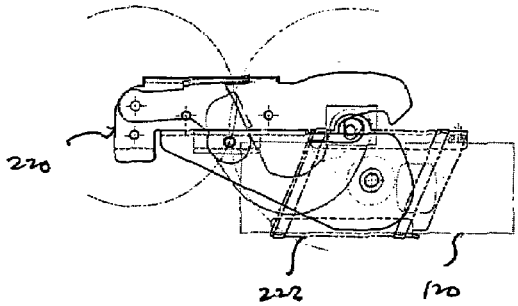
Figures 25A, 25B, 25C:
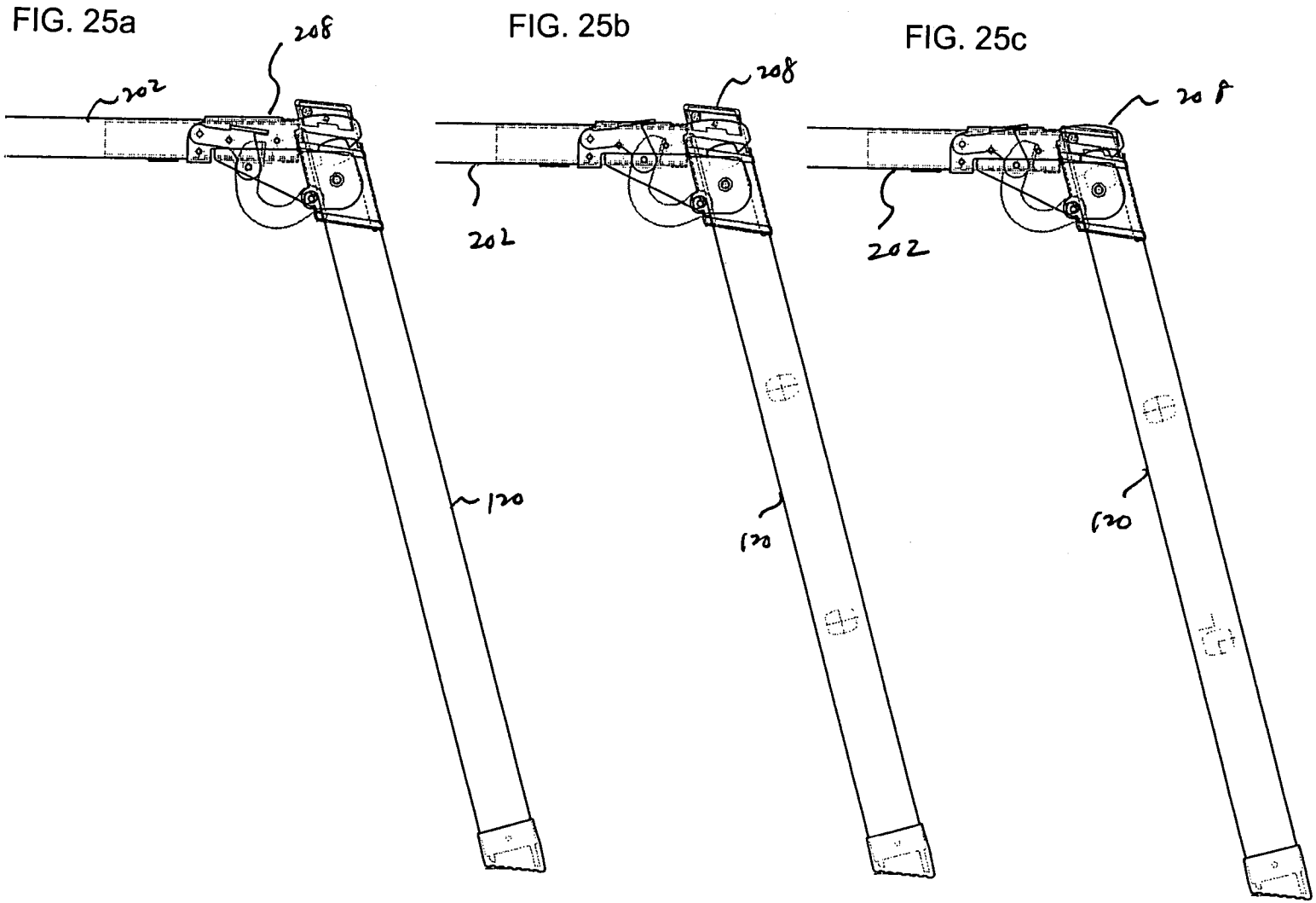
FIGS. 25*a* through 25*h* are elevation views showing the steps of adjusting the height of the folding work platform.
Figures 25D, 25E:
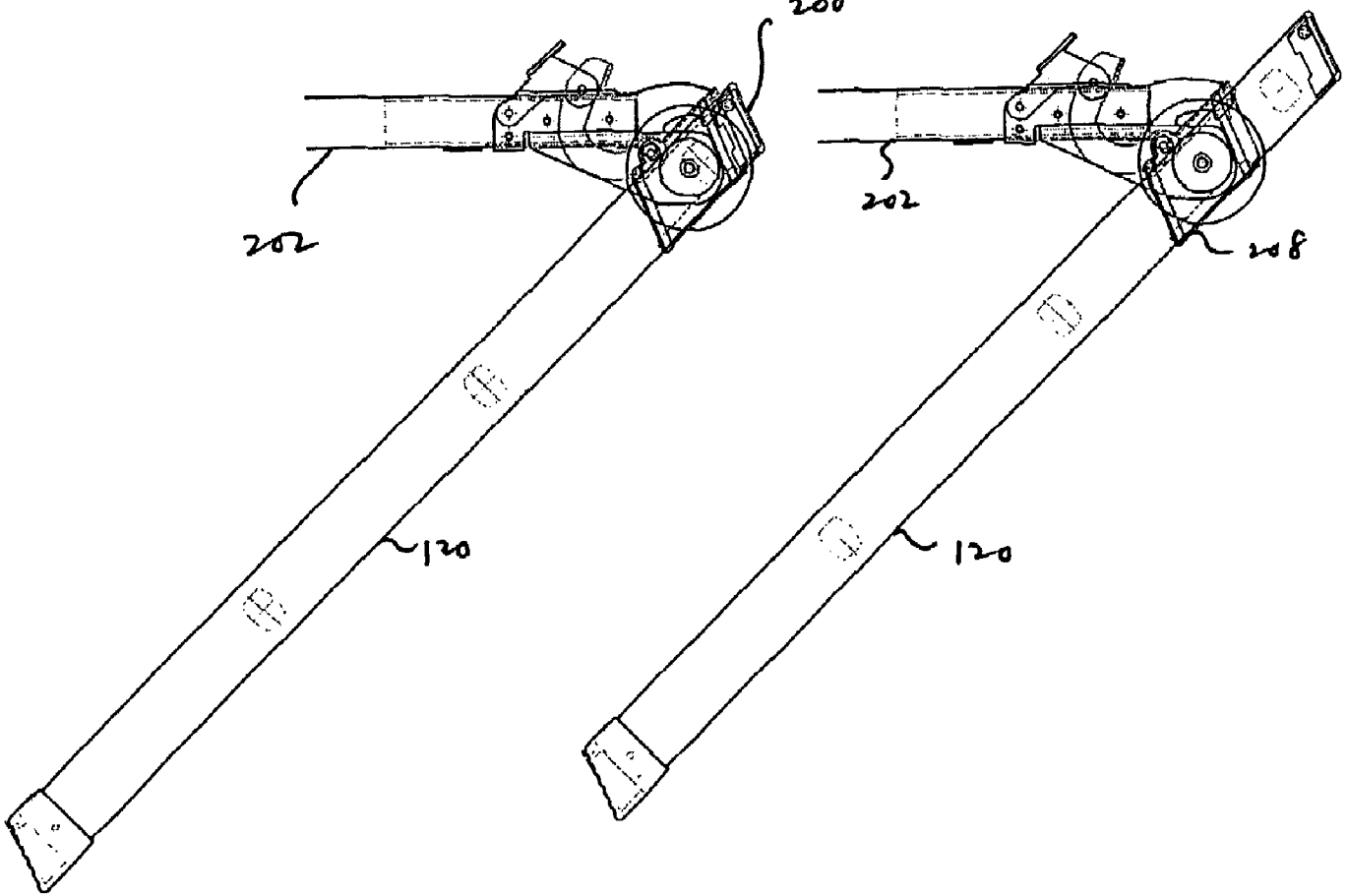
Figure 25H:
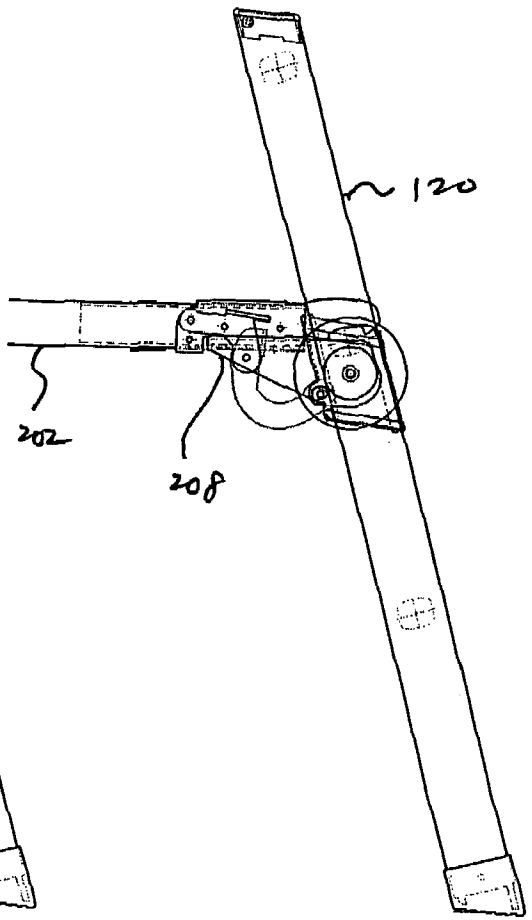
Figure 25G:
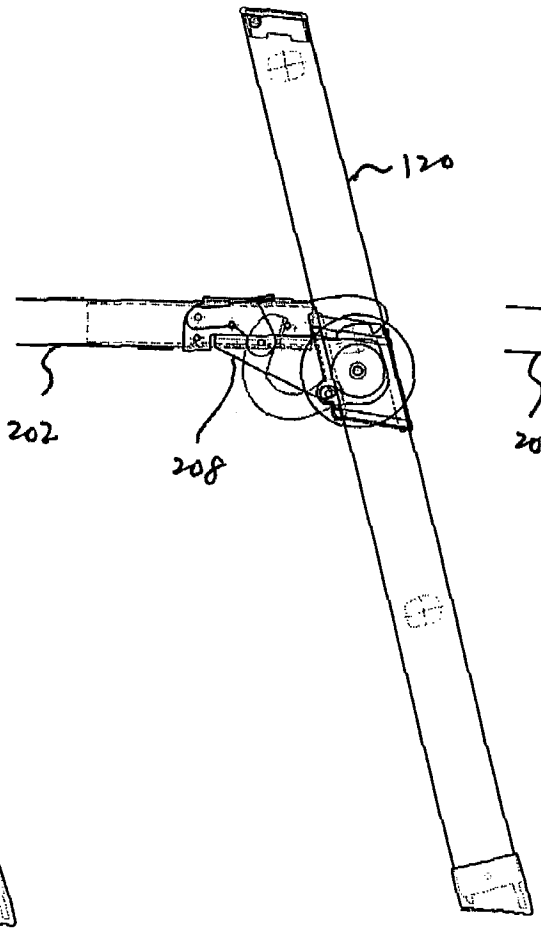
Figure 25F:
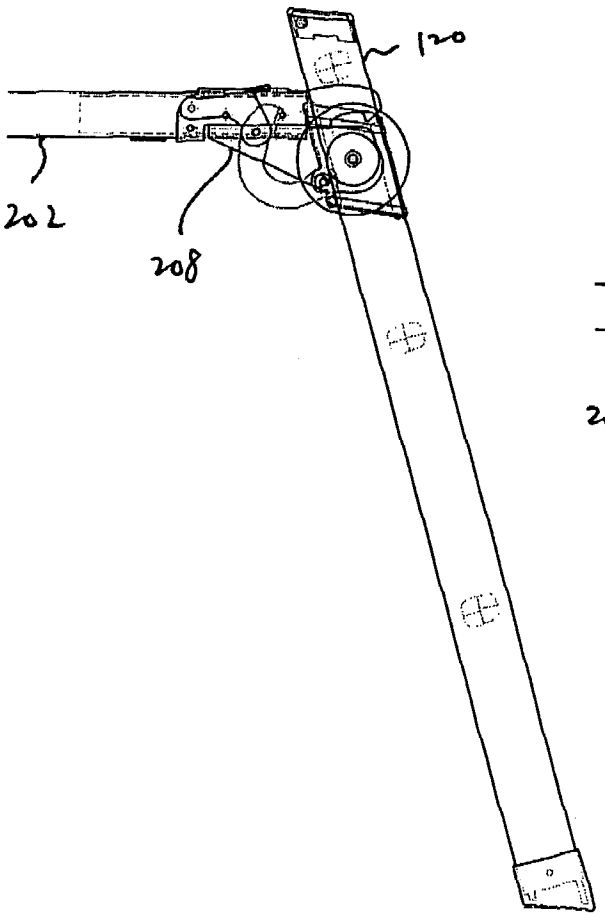

FIG. 24*a* shows that the middle pivot point 236 is spaced downward from the line connecting the first pivot point 232 and the second pivot point 234 when the safety lock device 226 is in a locked position. In the unfolded state, the weight of a user of the folding work platform 200 always generates force downward on the parts of the folding work platform 200. Since the middle pivot point 236 is spaced downward from the line connecting the first pivot point 232 and the second pivot point 234, no matter how great a weight is applied, the resultant force applied on the middle pivot point 236 always point downward, and thus the safety lock device 226 is kept locked. By manually lifting the first lever 228, the middle pivot point may be rotated upward from the line connecting the first pivot point 232 and the second pivot point 234.

FIG. 24*b*~24*g* show that the middle pivot point 236 is spaced upward from the line connecting the first pivot point 232 and the second pivot point 234 when the safety lock device 226 is in a unlocked position. With the safety lock device 226 unlocked, the second fixing portion 222 may be freely rotated, and thus the legs 120 can be folded. FIG. 24*b* ~24*g* show gradual steps that the leg 120 is pivoted until it is horizontal.

Referring back to FIG. 16, the first lever 228 has a handle 238 that is adapted to receive manual force to move the middle pivot point 236 between the downward and upward positions.

Referring back to FIG. 24*a*~24*g*, the safety lock device 226 pivots the second fixing portion 222 inward as the middle pivot point 236 moves upward.

The first fixing portion 220 includes an engaging hook 240 that engages with the cross member 212 of the leg 206 and is provided on the outer end of the first fixing portion 220.

The second fixing portion 222 includes a guide rail 242, into which the leg 206 slides.

Figure 23:
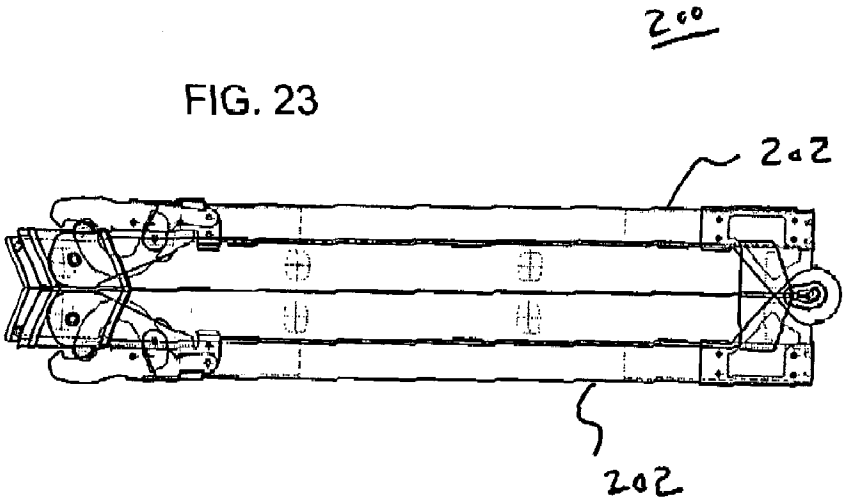
FIG. 23 is an elevation view showing that the footplates and legs are folded.
Figure 22:
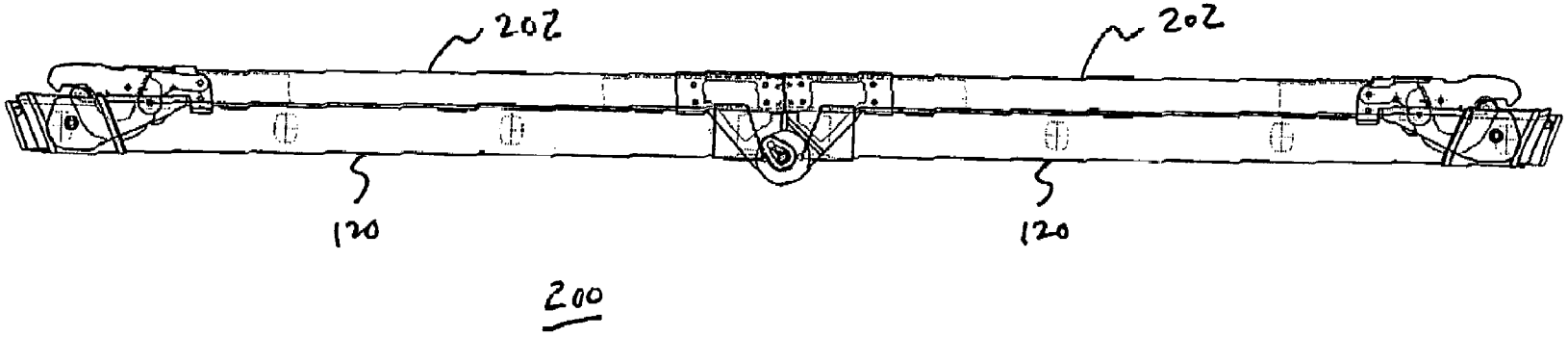
FIG. 22 is an elevation view showing that the legs are folded.

FIG. 22 shows that the legs 120 are folded, and FIG. 23 shows that the footplates 202 are folded, and thus the folding work platform 200 is ready to be carried and stored.

Figure 26:
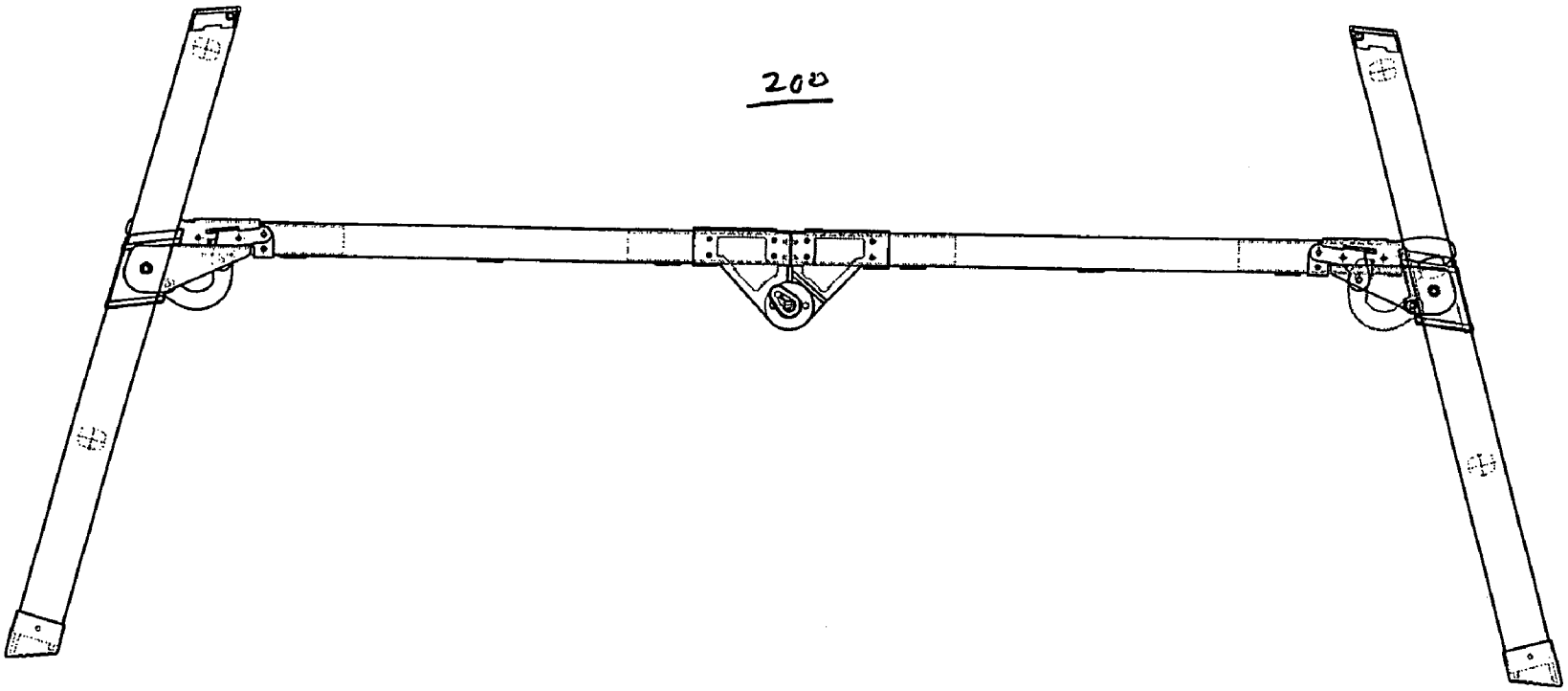
FIG. 26 is an elevation view showing the folding work platform, the height of which is adjusted.

FIG. 25*a*~25*h* show the gradual steps of changing the height of the folding work platform 200. FIG. 26 shows that the folding work platform 200 in changed height.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A height adjustable folding work platform comprising:

a) two footplates;

b) a footplate folding portion that foldably connects the footplates;

c) two legs; and d) two leg folding portions, each of which connect the leg to the outer end of the footplate, wherein the leg folding portion comprises a first fixing portion that is fixed the outer end of the footplate, a second fixing portion, and a hinge axis that pivotally connects the first fixing portion and the second fixing portion, wherein the first fixing portion comprises an engaging hook that engages with the cross member of the leg and is provided on the outer end of the first fixing portion, wherein the second fixing portion comprises a guide rail, into which the leg slides, wherein the first fixing portion further comprises a safety hook, wherein the safety hook is pivotally attached to the engaging hook, wherein the safety hook comprises a hook that is formed on the end of the safety hook, wherein each of the legs comprises two support legs and a plurality of cross members that connect the support legs, wherein the leg folding portion selectively engages with one of the cross members, wherein the engaging hook of the first fixing portion and the hook of the safety hook fix the position of the leg by fixing the cross member that slides in the guide rail of the second fixing portion such that the height of the height adjustable folding work platform is adjusted, wherein the leg folding portion further comprises a safety lock device that prevents accidental folding of the legs, wherein the safety lock device comprises a first lever and a second lever, wherein one end of the first lever is pivotally connected to the first fixing portion at a first pivot point, wherein one end of the second lever is pivotally connected to the second fixing portion at a second pivot point, wherein the other end of the first lever is pivotally connected to the other end of the middle pivot point is space downward from a line connecting the first pivot point and the second pivot point when the safety lock device is in a locked position, wherein the middle pivot point is spaced upward from the line connecting the first pivot point and the second pivot point when the safety lock device is in a unlocked position, whereby the safety lock device locks the legs unfolded when the safety lock device is in the locked position.

2. The height adjustable folding work platform of claim 1, wherein the first lever has a handle that is adapted to receive manual force to move the middle pivot point between the downward and upward positions.

3. The height adjustable folding work platform of claim 1, wherein the safety lock device pivots the second fixing portion inward as the middle pivot point moves upward.

4. The height adjustable folding work platform of claim 3, wherein the first fixing portion comprises an engaging hook that engages with the cross member of the leg and is provided on the outer end of the first fixing portion.

5. The height adjustable folding work platform of claim 4, wherein the second fixing portion comprises a guide rail, into which the leg slides.

* * * * *